United States Patent [19]

Kashizaki

[11] Patent Number: 4,975,349

[45] Date of Patent: Dec. 4, 1990

[54] ELECTROPHOTOGRAPHIC PHOTOSENSITIVE MATERIAL USING AZO PIGMENT CONTAINING COUPLER COMPONENT

[75] Inventor: Yoshio Kashizaki, Tokyo, Japan

[73] Assignee: Canon Kabushiki Kaisha, Tokyo, Japan

[21] Appl. No.: 315,812

[22] Filed: Feb. 27, 1989

[30] Foreign Application Priority Data

Feb. 26, 1988 [JP] Japan ..... 63-41952

[51] Int. Cl.[5] ..... G03G 5/06

[52] U.S. Cl. ..... 430/58; 430/79

[58] Field of Search ..... 430/58, 72, 73, 78, 430/79

[56] References Cited

U.S. PATENT DOCUMENTS 4,123,270 10/1978 Heil et al. ..... 430/73

4,687,721 8/1987 Emoto et al. ..... 430/58

*Primary Examiner*—John L. Goodrow

*Attorney, Agent, or Firm*—Fitzpatrick, Cella, Harper & Scinto

[57] ABSTRACT

An electrophotograph photosensitive material comprising a photosensitive layer containing an azo pigment on an electroconductive substrate thereof, wherein said azo pigment in which an organic comprises residual group as expressed by the following general formula (I) bonded to an aromatic hydrocarbon group or an aromatic heterocyclic group optionally via a bonding or coupling group:

(I)

wherein X is a residual group for forming an aromatic hydrocarbon group or an aromatic heterocyclic group condensed with a benzene ring, A is —$NR_4$— wherein $R_4$ is a hydrogen atom, alkyl group, aralkyl group or aryl group, $R_1$ is a hydrogen atom, alkyl group, aralkyl group or aryl group, and $R_2$ and $R_3$ each is a hydrogen atom, alkyl group, aralkyl group, carbamoyl group, aryl group, heterocyclic group, halogen atom, nitro group, acyl group, cyano group or together, $R_2$ and $R_3$ form a ring and are the same or different from each other.

6 Claims, No Drawings

ELECTROPHOTOGRAPHIC PHOTOSENSITIVE MATERIAL USING AZO PIGMENT CONTAINING COUPLER COMPONENT

BACKGROUND OF THE INVENTION

1. Field of the Invention

The present invention relates to an electrophotographic photosensitive material displaying improved sensitivity characteristics and improved durable potential stability. In particular, the present invention relates to an electrophotographic photosensitive material having a photosensitive layer containing an azo pigment having a specific coupler component.

2. Related Background Art

Hitherto, there were known electrophotographic photosensitive materials using, as the photosensitive component, inorganic photoconductive materials, such as selenium, cadmium sulfide, and zinc sulfide.

On the other hand, a variety of organic photoconductive materials have been developed because specific organic compounds can display the desired photoconductivity. For example, there are known organic photoconductive polymers, such as poly-N-vinyl carbazole and polyvinyl anthracene; low molecular weight organic photoconductive material, such as carbazole, anthracene, pyrazolines, oxadiazoles, hydrazones and polyaryl alkanes; and organic pigments and dyes, such as phthalocyanine pigment, azo pigment, cyanine dyes, polycyclic quinone pigment, perylene pigment, indigo dyes, thioindigo dyes and squalinecic acid methine dyes. In particular, a variety of photoconductive organic pigments and dyes have been disclosed since these organic pigments and dyes displaying the desired photoconductivity can be easily prepared compared to in organic materials and the variation for selecting compounds displaying photoconductivity in a desired wave length region has been widened.

For example, electrophotographic photosensitive material using an azo pigment displaying photoconductivity as a charge generating material in a functionally divided photosensitive layer having a charge generating layer and a charge transporting layer, is known. Such materials were disclosed in U.S. Pat. Nos. 4,123,270, 4,247,614, 4,251,613, 4,251,614, 4,256,821, 4,260,672, 4,268,596, 4,278,747, and 4,293,628.

Since the electrophotographic photosensitive materials using such organic photoconductive material can be prepared by painting them with a suitably selected binder, they can display a significantly improved productivity. As a result, a cost reduced photosensitive material can be provided. In addition, an advantage can be also obtained that the photosensitive wavelength region can be controlled as needed by selecting the organic pigments properly. However, such photosensitive materials can display poor sensitivity and durability with respect to those involved by inorganic photosensitive materials.

There is a disazo pigment disclosed in Japanese Patent Laid-Open No. 60-209740. This disazo pigment serving as the moiety adjacent to the coupler portion of the azo pigment used in the present invention.

However, this disazo pigment suffers from poor residual potential and stability after being used repeatedly.

SUMMARY OF THE INVENTION

An object of the present invention is to provide an electrophotographic photosensitive material capable of displaying improved high sensitivity characteristics and stable potential characteristics even after being used repeatedly.

The inventor of the present invention found the following information. In the disazo pigment disclosed in the above-described Japanese Patent Laid-Open No. 60-209740 and expressed by the following general formula:

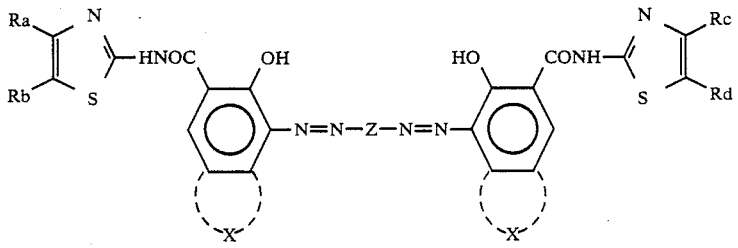

wherein, Ra, Rb, Rc, and Rd represent substituents, Z represents the central structure, and X represents a residual group needed to form an aromatic hydrocarbon group or aromatic heterocyclic group by condensing with a benzene group, by making the thiazole ring, which is, in main, disposed in the coupler portion-an imidazole ring, and by introducing an electron attractive group, such as a cyano group, or acetyl group as the substituent to the former, there results a relative improvement in the accepting performance of the pigment, which permits the stability to be maintained even after repeated used. In particular, excellent potential characteristics and stability are provided even after repeated use when the N-substituent on the imidazole ring is a hydrogen atom. The reason for this improvement has not been cleared up yet, but it can be considered that the crystal orientation between the pigment molecules is improved due to an increase in the hydrogen bonding performance between molecules.

That is, the present invention provides an electrophotographic photosensitive material comprising a photosensitive layer containing layer containing an azo pigment on the electroconductive substrate thereof, wherein said azo pigment comprises in which an organic residual group as expressed by the following general formula (I) bonded to an aromatic hydrocarbon group or an aromatic heterocyclic group which can be combined optionally via a bonding group:

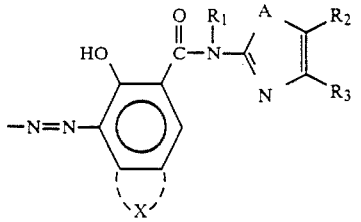

(I)

wherein X represents a residual group for forming an aromatic hydrocarbon group or an aromatic heterocyclic group condense with a benzene ring, A represents —$NR_4$— wherein $R_4$ represents a hydrogen atom; alkyl group such as methyl, ethyl and propyl; aralkyl group such as benzyl, phenethyl and naphthyl methyl; or aryl group such as phenyl and diphenyl, $R_1$ represents a hydrogen atom; alkyl group such as methyl, ethyl and propyl; aralkyl group such as benzyl, phenethyl and naphtyl methyl; or aryl group such as phenyl and diphenyl, $R_2$ and $R_3$ represent hydrogen atom; alkyl group such as methyl, ethyl and propyl; aralkyl group such as benzyl, phenethyl and naphthyl methyl; carbamoyl group, aryl group such as phenyl and diphenyl, heterocyclic ring group such as pyridyl, thienyl, furyl; halogen atom such as fluorine, chlorine, bromine and iodine; nitro group; acyl group such as acetyl and propionyl; or cyano group. $R_2$ and $R_3$ may be the same or be different from each other. $R_2$ and $R_3$ may form a ring in association with each other.

The above-described specific azo pigment according to the present invention can be further expressed by the following general formula (II):

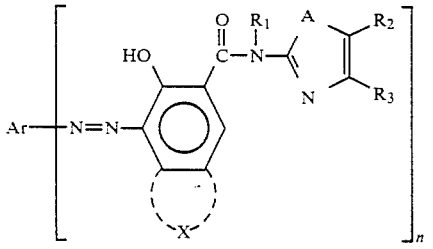

(II)

wherein Ar represents an aromatic hydrocarbon group or aromatic heterocyclic group which may be bonded optionally via a bonding or coupling group, n represents the integer 1, 2, 3, or 4. X and $R_1$ to $R_3$ have the same meaning as in the general formula (I).

X can be exemplified by a residual group for forming an aromatic hydrocarbon or aromatic heterocyclic group, which may optionally have a substituent, by being condensed with a benzene ring. The residual group is specifically exemplified by: naphthalene; anthracene, carbazole, benzcarbazole, dibenzcarbazole, dibenzfuran, benznaphthofuran, fluorenone or diphenyl sulfide. A substituent for X can be exemplified by: alkyl group such as methyl, ethyl, propyl; alkoxy group such as methoxy and ethoxy; substituted amino group such as diethyl amino dimethyl amino, halogen atom such as fluorine atom, chlorine atom, and bromine atom; nitro group; cyano group; and halo methyl group such as trifluoromethyl.

As Ar which is the aromatic hydrocarbon group of the aromatic heterocyclic group which may be optionally bonded via a bonding group to an organic residual group expressed by a general formula (I) there can be exemplified (1) an aromatic hydrocarbon group which may optionally have a substituent such as benzene, naphthalene, fluorene, phenanthrene, anthracene, pyrene; and (2) an aromatic heterocyclic group which optionally may have a substituent, such as: furan; thiophene; pyridine; indole; benzothiazole; carbazole; acridone; dibenzthiophene; benzoxazole; benztriazole; oxadiazole; and thiadiazole. Furthermore, those Ar groups which may have a substituent are also exemplified by: triphenylamine; diphenylamine; N-methyl diphenylamine; biphenyl; terphenyl; binaphthyl; fluorene; phenanthraquinone; anthraquinone; benzanthrone; diphenyl oxadiazole; phenyl benzoxazole; diphenyl methane; diphenyl sulfone; diphenyl ether; benzphenone; stilbene; distilbenzene; tetraphenyl-p-phenylene diamine; tetraphenyl benzidine and tetraphenyl benzidine. The substituent for Ar can be exemplified by: alkyl group such as methyl, ethyl, propyl, and butyl; alkoxy group such as methoxy and ethoxy; dialkylamino group such as diethylamino and dimethylamino; halogen atom such as fluorine atom, chlorine atom and bromine atom; hydroxy group; nitro group; cyano group; halomethyl group; or substituted azo group expressed by general formula —N=N—Cp (III) (wherein Cp represents a coupler residual group having a phenol hydroxyl group).

A preferred example of Cp contained in the above-described general formula (III) can be exemplified by a group having a structure expressed by the following general formula:

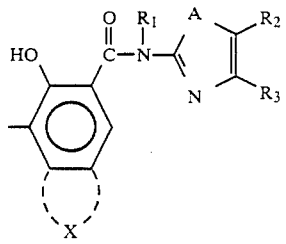

(IV)

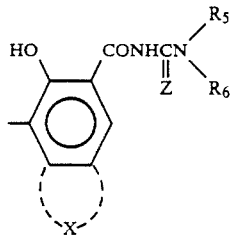

(V)

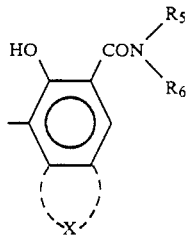

(VI)

-continued (VII)

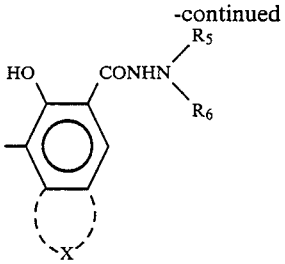

(VIII)

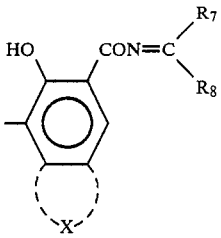

(IX)

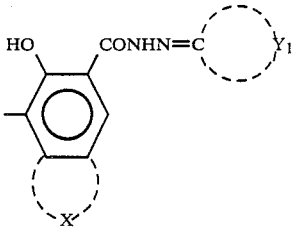

(X)

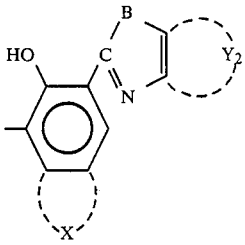

(XI)

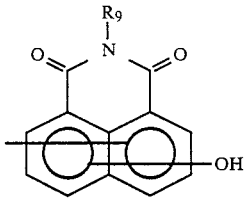

(XII)

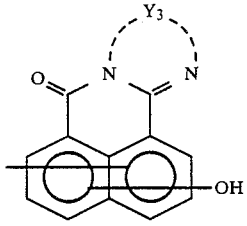

wherein X, $R_1$, $R_2$ and $R_3$ represent the same meanings as those contained in general formula (I), and $R_5$ and $R_6$ each represent hydrogen atoms; alkyl groups, aralkyl groups, aryl groups, heterocyclic groups which may have a substituent, and cyclic amino group which contains a nitrogen atom to which $R_5$ and $R_6$ are bonded. $R_7$ and $R_8$ each represent: alkyl groups, aralkyl groups, aryl groups or heterocyclic groups which may have a substituent. $R_9$ represents an alkyl group; aralkyl group; aryl group; or a heterocyclic group which may have a substituent. Y1 represents a bivalent aromatic hydrocarbon group or heterocyclic group. The group $=CY_1$ can be exemplified by:

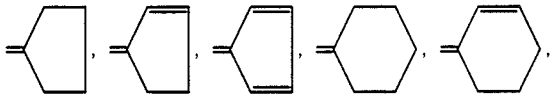

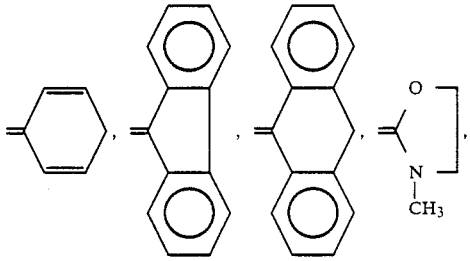

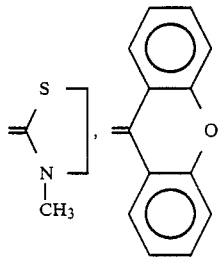

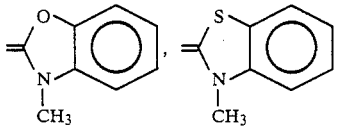

$Y_2$ represents bivalent aromatic hydrocarbon group which may have a substituent, and is exemplified by: o-phenylene; o-naphthylene; perinaphthylene; 1, 2-anthrylene; 9, 10-phenanthrene. Y3 represents bivalent aromatic hydrocarbon group which may optionally have a substituent or a bivalent heterocyclic group containing a nitrogen atom in the ring thereof. As the bivalent aromatic hydrocarbon group the following groups can be exemplified: o-phenylene; o-naphthylene; perinaphthylene; 1, 2-anthrylene, and 9, 10-phenanthrene can be exemplified. As the bivalent heterocyclic group containing a nitrogen atom in the ring thereof there are: 3, 4-pyrazoledyl, 2, 3-pyridinedyl, 4, 5-pomidinedyl, 6, 7-indazoledyl, 5, 6-benzimidazoledyl, and 6, 7-quinolinedyl. Z represents an oxygen atom or sulfur atom. B represents an oxygen atom, sulfur atom or an N-substituted group or non-substituted imino group. The substituent for N can be exemplified by an alkyl group, aralkyl group and aryl group which may have a substituent.

As the alkyl group in the above description the following can be exemplified: methyl, ethyl, propyl and butyl groups, and as the aralkyl group, benzil, phenethyl and naphthylmethyl groups can be exemplified. As the aryl group, phenyl, diphenyl, naphthyl, and anthryl groups can be exemplified. The heterocyclic group can be exemplified by pyridyl, thienyl, furyl, thiazoryl, carbazoryl, dibenzfuryl, benzimidazoryl, and benzthiazoryl groups. The cyclic amino group containing a nitrogen atom in the ring thereof can be exemplified by: the cyclic amino groups derived from pyrrole; pyrroline; pyrrolidine; pyrrolidone; indole; indoline; isoindole; carbazole; benzindole; imidazole; pyrazole; pyrazoline; oxadine; phenoaxadine; and benzcarbazole. As the acyl group; acetyl; propionyl benzoyl; and toluoyl groups can be exemplified.

As the substituent in the above description, the following can be exemplified: alkyl group such as methyl, ethyl, and propyl; alkoxy group such as methoxy and ethoxy; halogen atoms such as fluorine atom, chlorine atom, bromine atom and iodine atom; alkyl amino group such as dimethylamino and diethylamino; and halomethyl groups such as phenylcarbamoyl group, nitro group, cyano group and trifluoromethyl group.

In a case where azo pigment according to the present invention is formed in such a manner that R thereof is a hydrogen atom or a lower alkyl group such as methyl, ethyl, and propyl, $R_2$ and $R_3$ are electron attracting groups, and $R_4$ is a hydrogen atom or a lower alkyl group, an excellent electrophotographic sensitivity and an excellent potential characteristic can be obtained. In particular, the azo pigment whose $R_4$ is a hydrogen atom can display excellent effect.

The azo pigment specified by the present invention will be exemplified.

Exemplified Pigment (1-1)

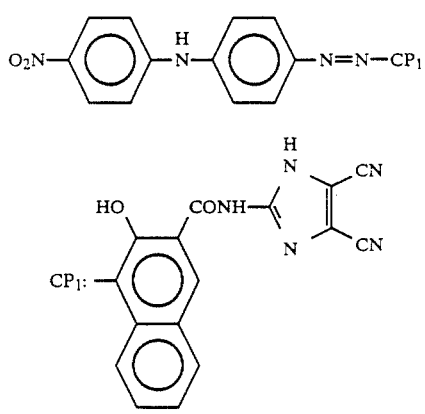

Exemplified Pigment (1-2)

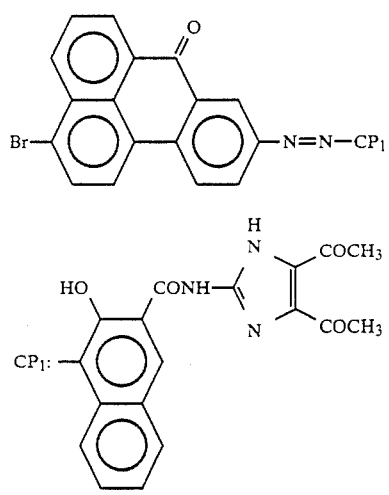

Exemplified Pigment (2-1)

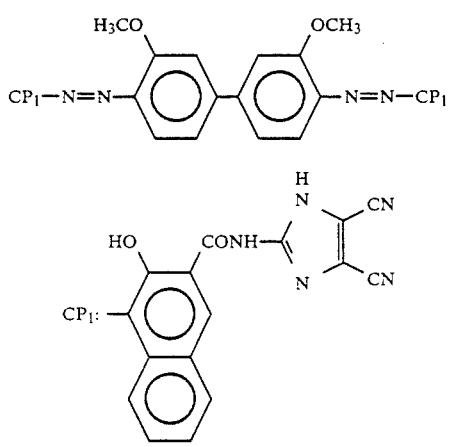

-continued
Exemplified Pigment (2-2)
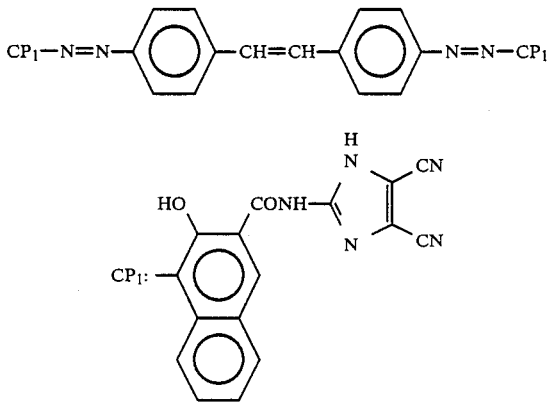
Exemplified Pigment (2-3)
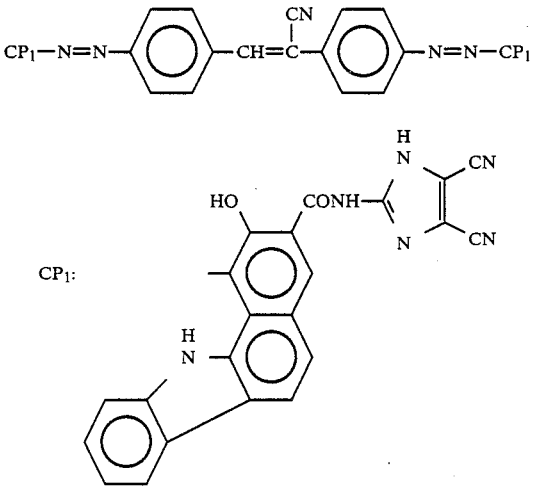
Exemplified Pigment (2-4)
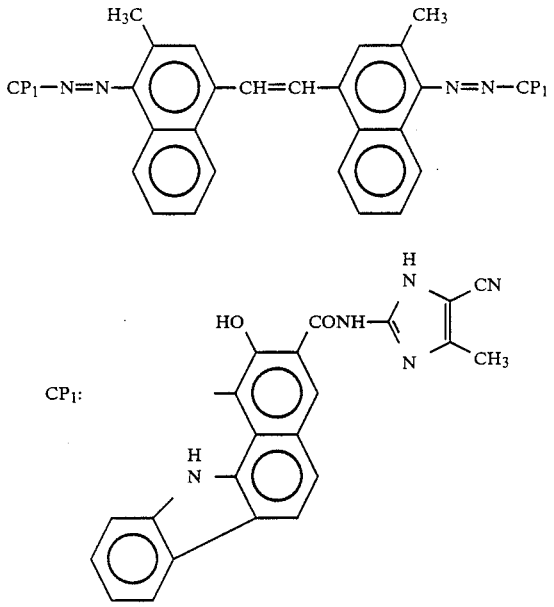
Exemplified Pigment (2-5)
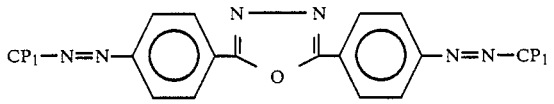

-continued
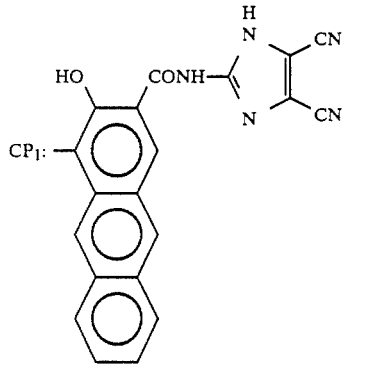
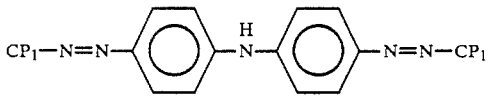
Exemplified Pigment (2-6)
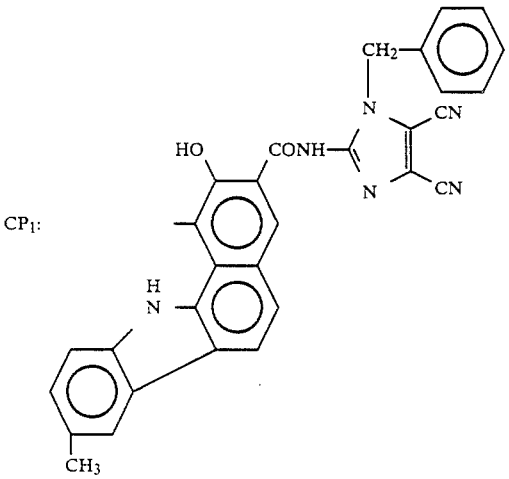
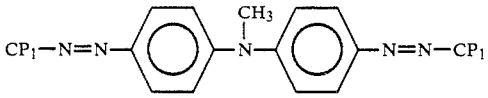
Exemplified Pigment (2-7)
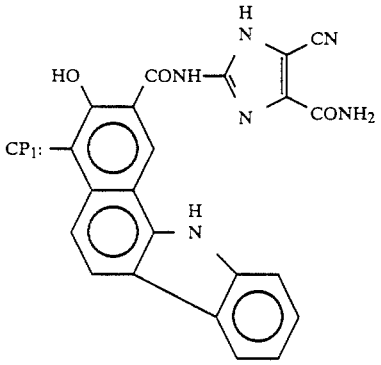
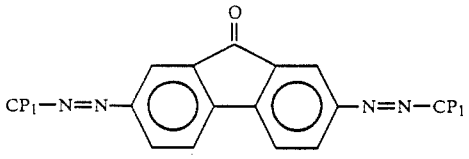
Exemplified Pigment (2-8)

-continued
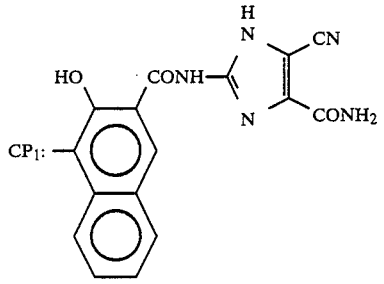
Exemplified Pigment (2-9)
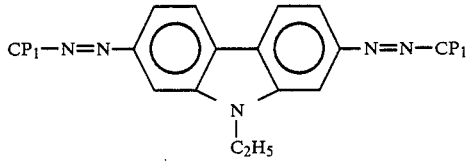
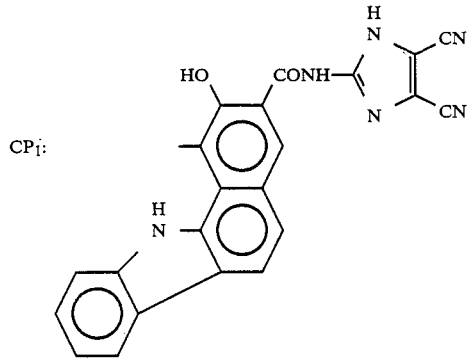
Exemplified Pigment (2-10)
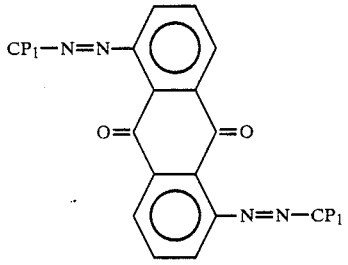
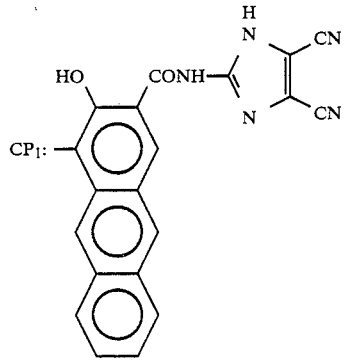
Exemplified Pigment (2-11)
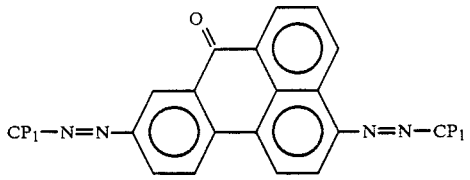

-continued
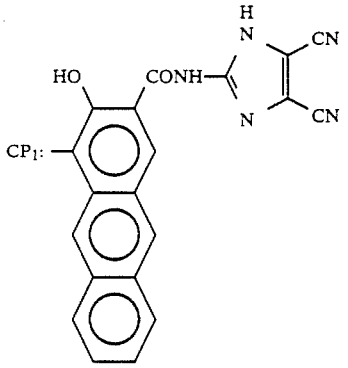
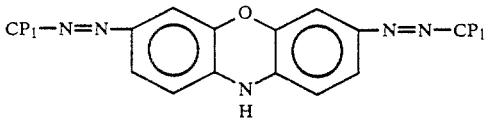
Exemplified Pigment (2-12)
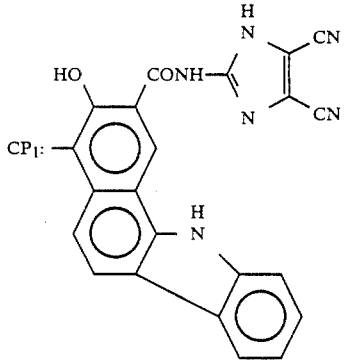
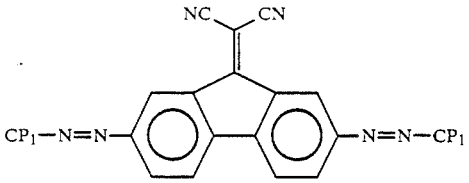
Exemplified Pigment (2-13)
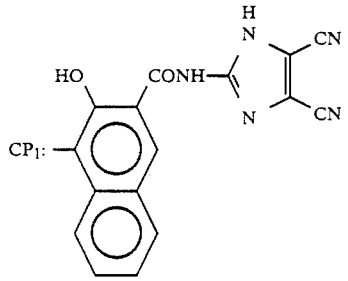
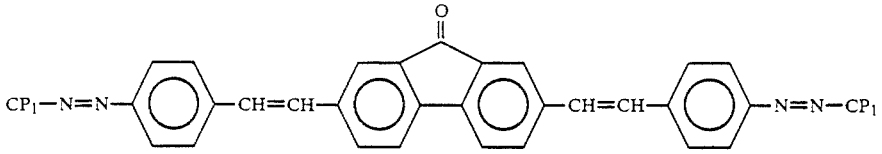
Exemplified Pigment (2-14)

-continued
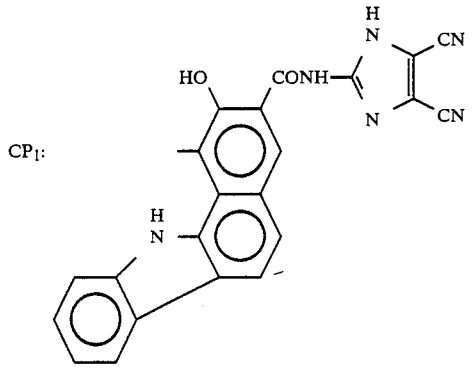
Exemplified Pigment (2-15)
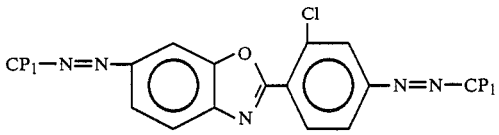
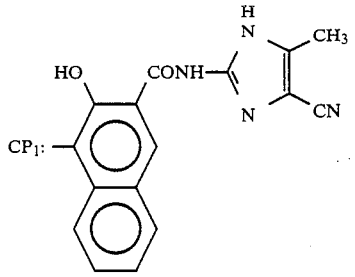
Exemplified Pigment (2-16)
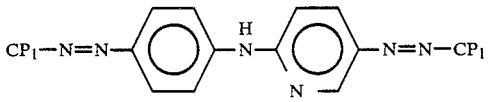
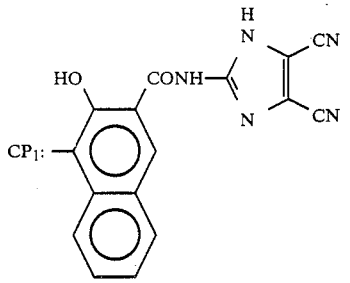
Exemplified Pigment (2-17)
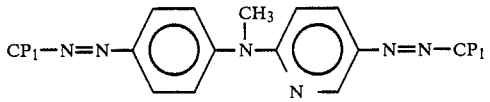
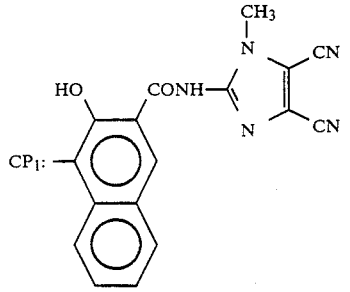

-continued
Exemplified Pigment (2-18)
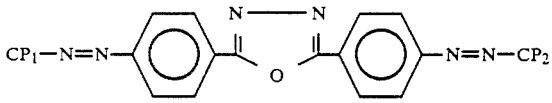
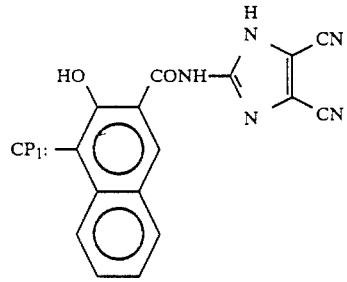
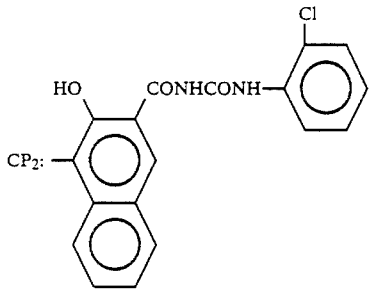
Exemplified Pigment (2-19)
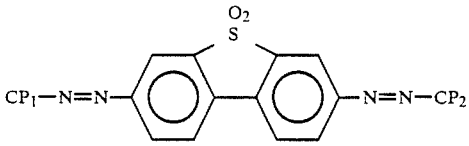
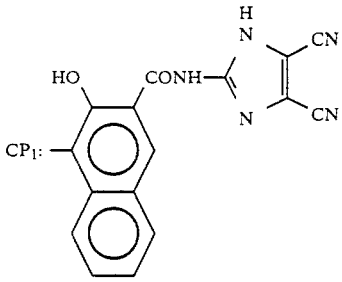
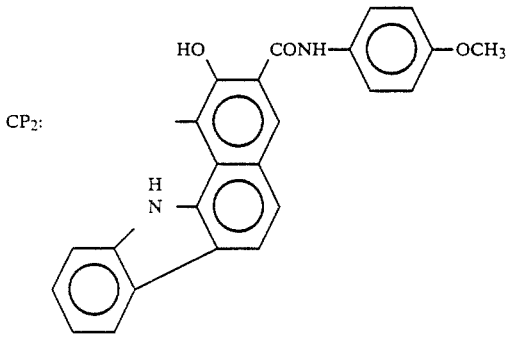
Exemplified Pigment (2-20)
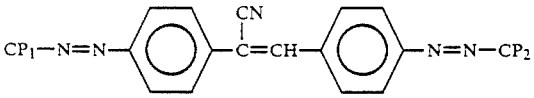

-continued
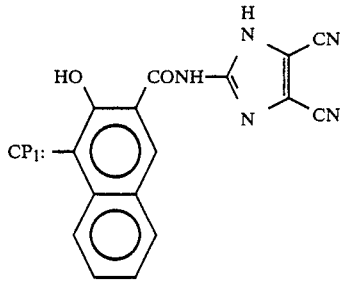
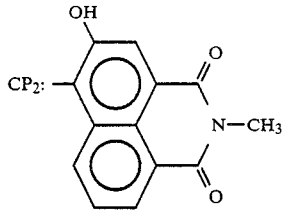
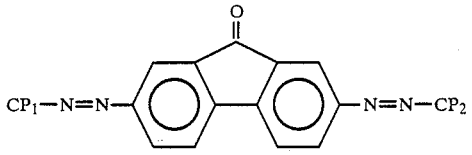
Exemplified Pigment (2-21)
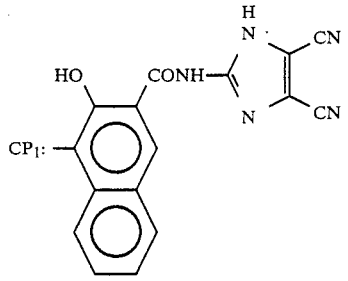
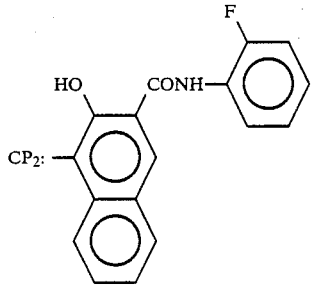
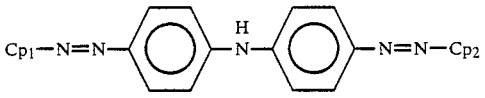
Exemplified Pigment (2-22)

-continued
Cp1:
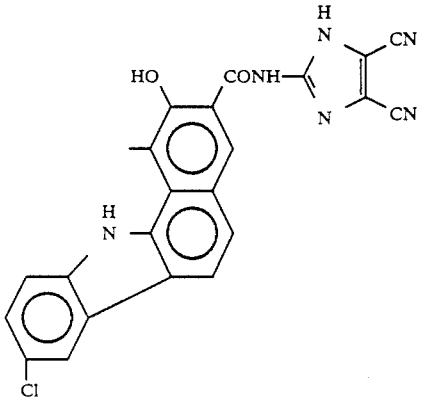
Cp2:
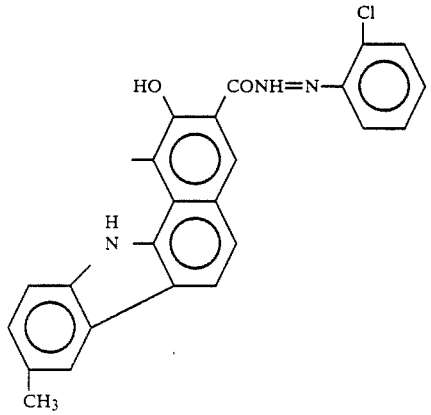
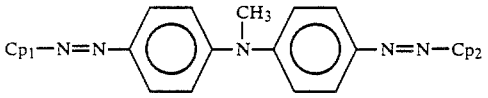
Exemplified Pigment (2-23)
Cp1:
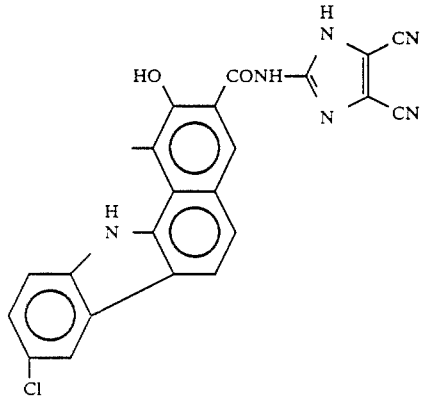

-continued
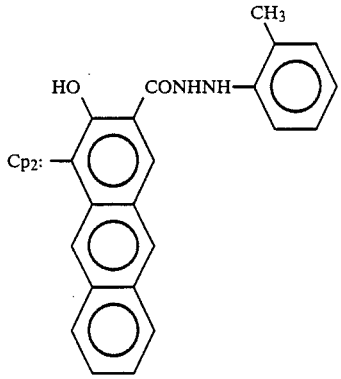
Exemplified Pigment (2-24)
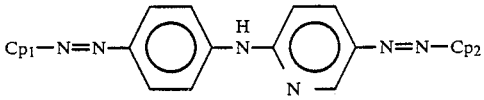
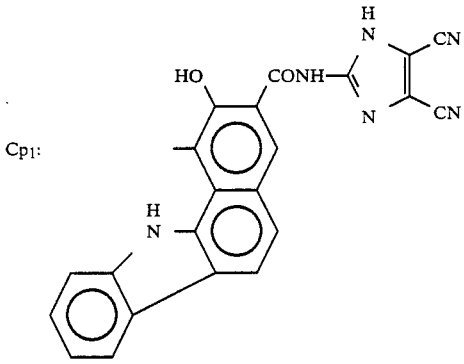
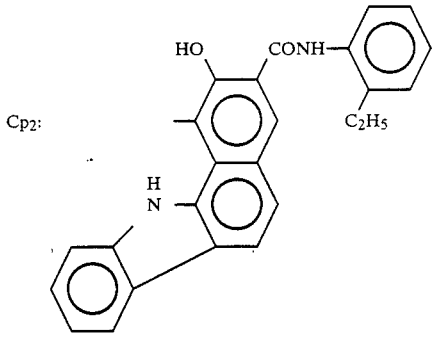
Exemplified Pigment (2-25)
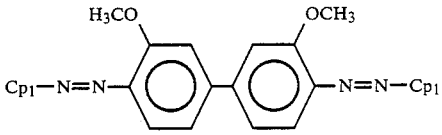
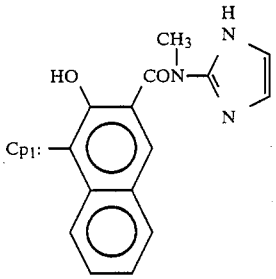

-continued
Exemplified Pigment (2-26)
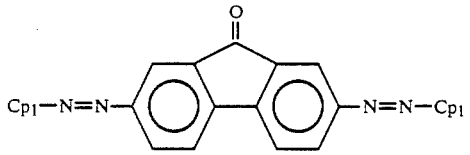
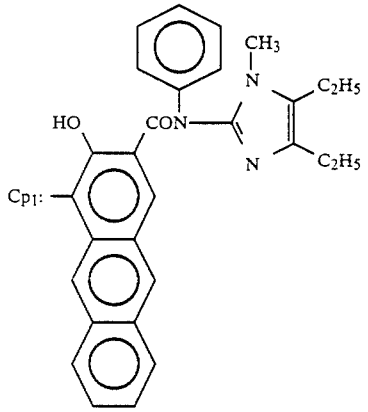
Exemplified Pigment (2-27)
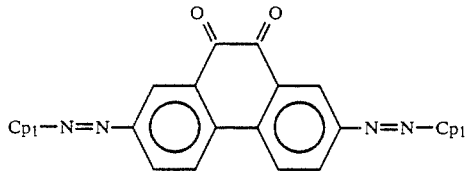
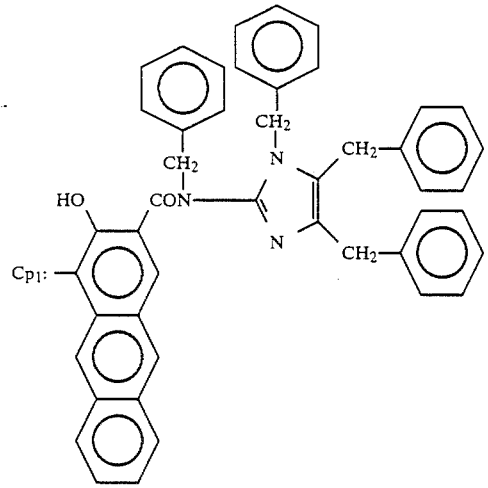
Exemplified Pigment (2-28)
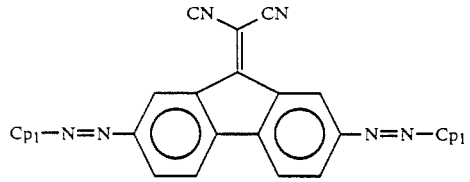

-continued
Cp1:
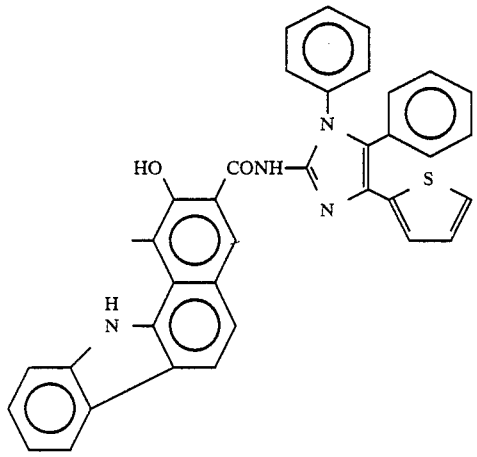
Exemplified Pigment (2-29)
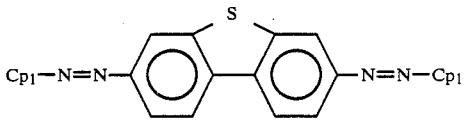
Cp1:
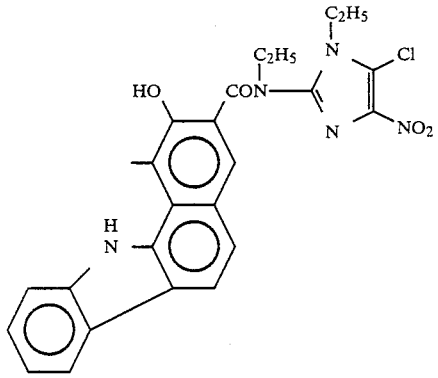
Exemplified Pigment (2-30)
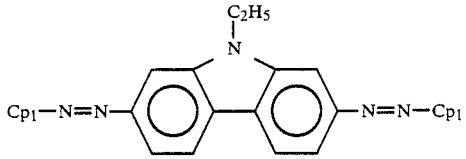
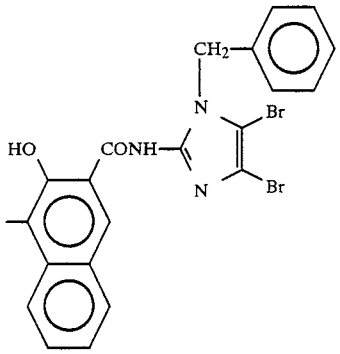

-continued
Exemplified Pigment (3-1)
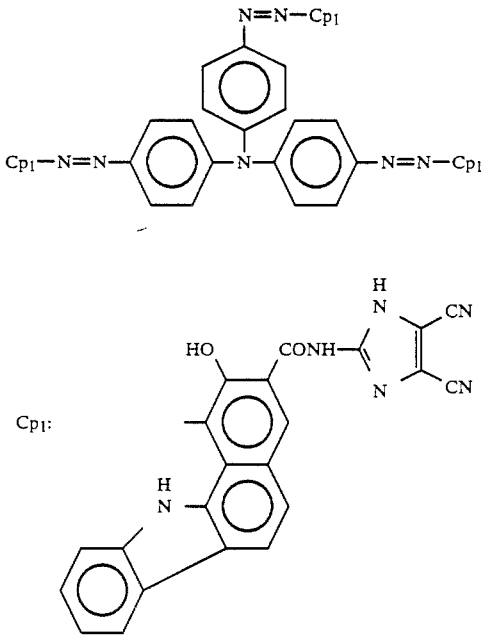
Exemplified Pigment (3-2)
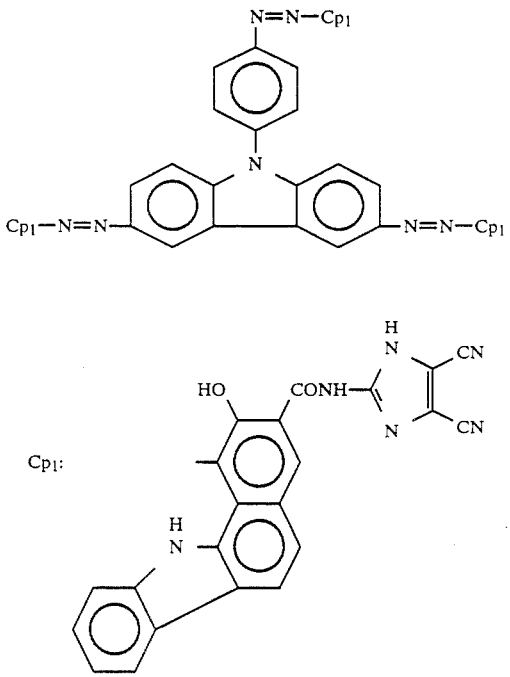
Exemplified Pigment (3-3)
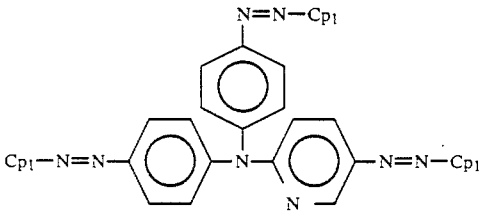

-continued
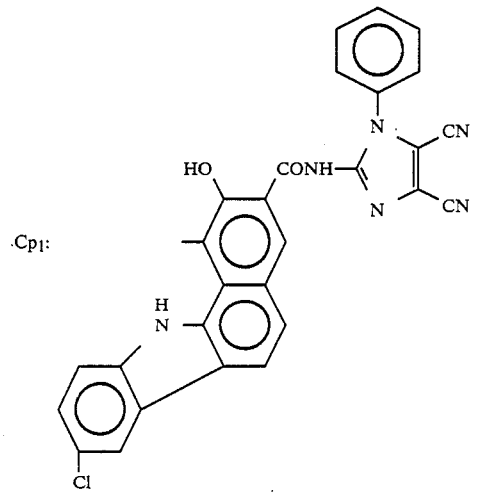
Exemplified Pigment (3-4)
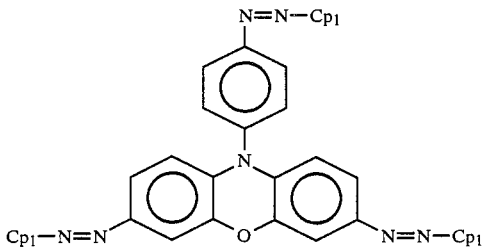
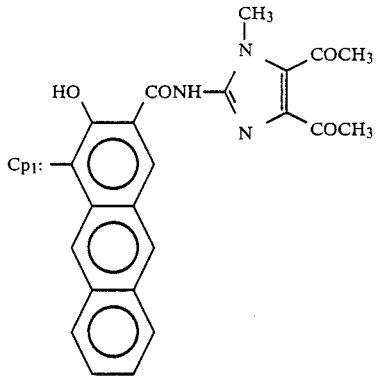
Exemplified Pigment (3-5)
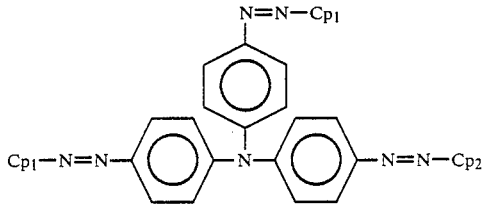

-continued
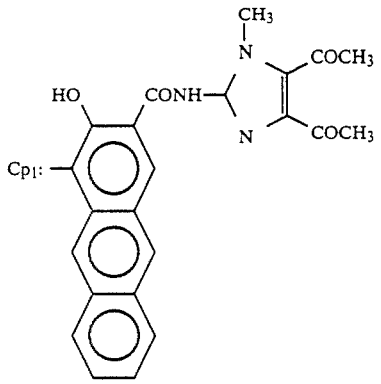
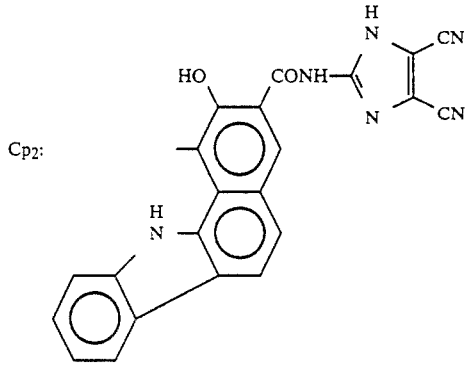
Exemplified Pigment (4-1)
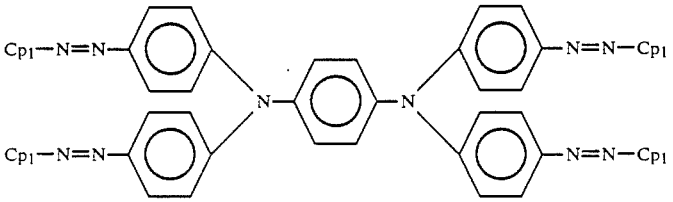
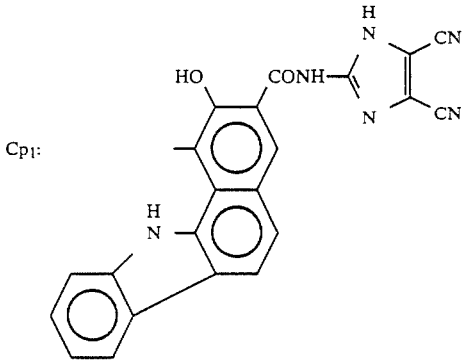
Exemplified Pigment (4-2)
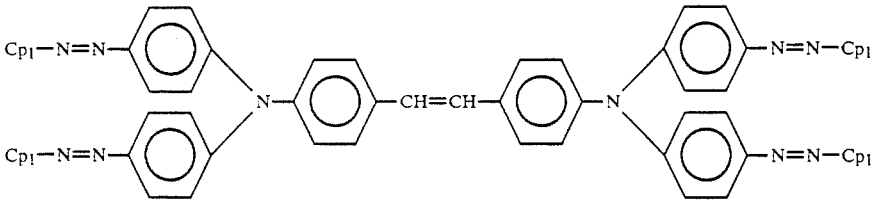

-continued

Cp1:

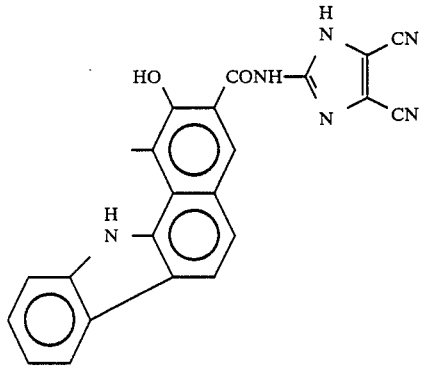

The coupler component used for preparing the azo pigment according to the present invention and expressed by the following general formula (XIII) can be obtained by heating an amine expressed by general formula (XIV) and 2-hydroxy-3-naphthoic acid together with phosphorous trichloride in a proper solvent. Alternatively, it can be obtained by obtaining, by the usual way, 2-hydroxy-3-naphthoic acid chloride and reacting this with an amine expressed by the following general formula (XIV).

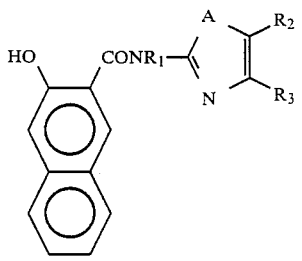

(XIII)

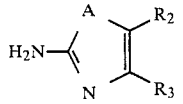

(XIV)

{wherein $R_1$, $R_2$, $R_3$, and A have the same meaning as those used in general formula (I)}.

The specific azo pigment for use in the present invention can be prepared by diazotizing the corresponding amino compound in a usual way, and coupling it with the thus-prepared coupler in the presence of alkali Alternatively, the diazonium salt of the corresponding amino compound is first isolated in the form of a salt of a borofluoride salt or a double salt of zinc chloride, and is coupled in, for example, an organic solvent such as N,N-dimethylformamide and dimethylsulfoxide in the presence of a base such as acetate soda, pyridine and triethylamine.

In case of a disazo pigment, trisazo pigment and tetraoxazo pigment of the above-described specific azo pigments, they can contain other coupler components if they satisfy the necessity that one or more coupler component expressed by general formula (XIII) is contained in one molecule.

The preparation method in this case will be described. The amino compound expressed by the following general formula (XV) is diazotized and the thus-diazotized material is coupled with a coupler expressed by general formula (XIII).

$$(CH_3CONH)_m—Ar—(NH_2)l \quad (XV)$$

(wherein Ar represents the same meaning as that in general formula (II), 1 and m represent an integer 1, 2, or 3, and 1+m represents 2, 3, or 4).

Then, the intermediate (XV) is hydrolyzed by a mineral acid such as hydrochloric acid to obtain:

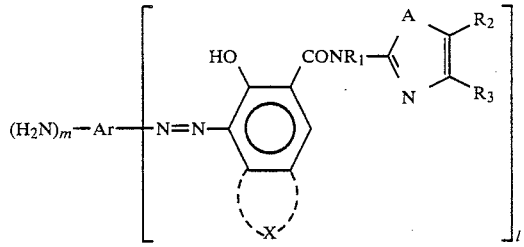

The thus-obtained material is again made a diazotized material and coupled to a coupler having another phenol hydroxyl group. Alternatively, it may be prepared as follows: an amino compound expressed by general formula $$Ar—(NH_2)_n \quad (XVI)$$

{wherein Ar represents the same meaning as that contained in general formula (II), and n represents the integer 2, 3, or 4} is made a diazonium salt by the usual way, and this salt is coupled in a solution in which the above-described coupler express by general formula (XII) and another coupler are mixed and dissolved.

Alternatively, the corresponding azo pigment may be prepared by first coupling the first coupler component so as to be monoazo body. Then each coupler component is similarly and successively added for performing coupling.

Process of preparation {exemplified pigment (2-1)}

200 ml water and 48 ml {0.54[M]} concentrated hydrochloric acid were enclosed in a 500 ml beaker. Then 20.0 g o-dianisidine {0.082[M]} was added with the contents in the beaker cooled down by an ice bath so that the temperature of the liquid was lowered to 0° to 3° C., with stirring Next, a liquid obtained by dissolving 12.0 g {0.174[M]} sodium nitrite in 20 ml water in 10 minutes had the temperature thereof maintained below 5° C. After the temperature of the liquid had been dropped, it was further stirred at the same temperature for 30 minutes. Carbon was added to the reacted liquid, and the mix was filtered. Next, a liquid obtained by dissolving 27.0 g {0.246[M]} borofluoride soda in 40 ml water was prepared. The thus-deposited borofluoride salt was collected through filtration. It was then washed with water and was vacuum-dried.

The resulting yield was 29.4 g and rate of yield was 81%.

Then, 200 ml DMF was enclosed in a 500 ml beaker. Next, 6.10 g {0.0201[M]} 2-hydroxy-3-naphthoic acid-N-(4, 5 dithianoimidazole-2-yl) was then dissolved, and the temperature of the liquid was lowered to 5° C., and 4.24 g {0.0096[M]} borofluoride salt which had been previously obtained was dissolved therein. Then, 1.94 g (0.0192[M]} triethylamine was introduced for 10 minutes Next, the mix was subjected to 2 hours of stirring. After the reacted liquid had been filtered, it was washed 5 times with 200 ml N,N-dimethylformamide, and was treated with acetone, and was vacuum dried so that the required pigment was obtained.

The resulting yield was 7.04 g, and the rate of yield was 84% (borofluoride salt base).

| Element Analysis | Calculated Value (%) | Measured Result (%) |
|---|---|---|
| C | 63.30 | 63.15 |
| H | 3.23 | 3.10 |
| N | 22.47 | 23.65 |

The film containing the above-described azo pigment displayed photoconductivity, as a result of which it can be used for the photosensitive layer of the electrophotographic photosensitive material.

In a preferred embodiment according to the present invention, the above-described specific azo pigment can be used as a charge generating material contained in the charge generating layer of the electrophotographic photosensitive material whose photosensitive layer is separated in function into a charge generating layer and a charge transporting layer.

It is preferable for the charge generating layer to contain the charge generating material as much as possible for the purpose of obtaining a sufficient absorbance. In addition, in order to decrease the distance through which the generated charge carrier travels, the thickness of the layer needs to be, for example, 5 μm or less, preferably 0.01 μm to 1 μm.

The reason for this is that the great part of the incidental light needs to be absorbed in the charge generating layer so as to generate a great number of charge carriers. In addition, the thus-generated charge carriers must be introduced into the charge transporting layer without any loss due the recombination or trapping.

The charge generating layer can be formed by dispersing the above-described azo pigment onto a proper binder and by applying the thus-dispersed pigment on the conductive substrate.

The binder for use at the time of forming the charge generating layer by a coating manner can be selected from a variety of insulating resins. It may also be selected from an organic photoconductive polymer such as poly-N-vinyl carbazole, polyvinyl anthracene, and polyvinyl pyrene. The preferable resins can be exemplified by insulating resins such as polyvinyl butryal, polyvinyl benzal, polyarylate (condensation polymer of bisphenol A and phthalic acid), polycarbonate, polyester, phenoxy resin, polyvinyl acetate, acryl resin, polyacryl amide, polyamide, polyvinyl pyridine, cellulose resin, urethane resin, casein, polyvinyl alcohol, polyvinyl pyrolidone. The content of resin contained in the charge generating layer needs to be 80 wt % or less, preferably 40 wt % or less.

The following substrate coating methods can be employed: dipping coating method, spray coating method, spinner coating method, bead coating method, meyer bar coating method, blade coating method, roller coating method, and curtain coating method.

It is preferable for the drying to be performed such that, after finer tough drying at room temperature, the subject is dried by heat. The heat drying can be performed at 30° to 200° C. for 5 minutes to 2 hours in a stable environment in the presence of an air supply.

The solvent to dissolve these resins is different in accordance with type of the resin selected. The solvent is preferably selected from types which cannot dissolve the charge transporting layer or the under coating layer.

Specifically, the organic solvent can be exemplified by: alcohols such as methanol, ethanol, and isoprophylalcohol; ketones such as acetone, methylethyl ketone, and cychlohexane; amides such as N,N-dimethyl formamide, and N-N-dimethyl acetoamide; sulfoxides such as dimethyl sulfoxide; ethers such as tetrahydrofuran, diozane, and ethyleneglycol monomethyl ether; esters such as methyl acetate and ethyl acetate; aliphatic halogen hydrocarbons such as chloroform, methylene chloride, dichaloroethylene, carbon tetrachloride, and trichloroethylene; and aromatic compounds such as benzene, toluene, xylene, ligroin, monochlorobenzene, and dichlorobenzene.

The charge transporting layer is positioned in electrically contact with the above-described charge generating layer so that it can receive, in the presence of the electric field, the charge carrier introduced from the charge generating layer, and further it can transport the thus-received charge carrier to the surface.

At this time, the charge transporting layer may be laminated on the charge generation layer, or alternatively, it may be laminated under the same.

However, the charge transporting layer is preferably laminated on the charge generating layer.

The charge transporting material can be exemplified by an electron transporting material and hole transporting material. The electron transporting material can be exemplified by electron attracting materials or polymers of the electron attracting materials exemplified by: chloroanyl; bromoanyl; tetracyanoethylene; tetracyanoquninodimethane; 2, 4, 7-trinitro-9-fluorenone; 2, 4, 5, 7-tetranitro-9-fluorenone; 2, 4, 7-trinitro-9-dicyanomethylene fluorenone: 2, 4, 5, 7-tetranitroxanthone; and 2, 4, 8-trinitrothioxanthone.

The hole transporting material can be exemplified by: hydrazone compounds such as N-ethyl carbazole, N-isopropyl carbazole, N-methyl-N-phenyl hydrodine-3-methylidene-9-ethyl carbazole, N, N-diphenyl hydradine-3-methylidene-10-ethylphenothiadine, N,N-diphenyl hydrodine-3-methylidine-10-ethylphenoxadine, p-diethyl aminobenzaldehide-N, N-diphenyl hydrazone, p-diethylamino benzaldehide-N-α-naphthil-N-phenyl hydrazone, p-pyrodinobenzaldehide-N, N-diphenyl hydrazone, 1,3,3-trimethylindolenine-2-aldehide-N, N-diphenyl hydrazone, p-diethylbenzaldehide-3-methylbenzazolinone-2-hydrazone; pyrazoline compounds such as: 2,5-bis (p-diethylaminophenyl)-1,3,4-oxadiazole, 1-phenyl-3-(p-diethyl aminostyryl)-5-(p-diethyl aminophenyl) pyrazoline, 1-[quinolyl(2)]-3-(p-diethylaminostylyl)-5-(p-diethyl aminophenyl) pyrozoline, spiropyrozoline; styryl compounds such as α-phenyl-4-N,N-diphenyl aminostilbene, N-ethyl-3-(α-phenylstyril) carbazole, 9-dibenzilaminobenzilydene-9H-fluorenone, 5-p-ditryl aminobenzilydene-5H-dibenz [a,d] cyclopentane oxazole compounds such as 2-(p-diethylaminostyryl)-6-diethylaminobenzoxazole, 2-(p-diethylaminophenyl)-4-(p-dimethylaminophenyl)-5-(2-chlorophenyl) oxazole; thiazole compounds such as 2-(p-diethylaminostyryl)- 6-diethylaminobenzthiazole; triaryl methane compounds such as bis(4-diethylamino-2-methylphenyl)-phenylmethane; polyarylalkanes such as 1,1-bis (4-N,N-diethylamino-2-methylphenyl)heptane, 1,1,2,2 tetrakis (4-N,N-dimethylamino-2-methylphenyl)ethane; triphenyl amine; poly-N-vinylcarbazole; polyvinylpyrene; polyvinylanthracene, polyvinylacridine; poly-9-vinylanthracene; pyreneformaldehyde resin; and ethylcarbazole formaldehyde.

These charge transporting materials can be used solely or in the form of a combination.

When the charge transporting material does not possess sufficient film forming performance, the film can be formed by selected a proper binder. The resins which can be used as the binder can be exemplified by: insulating resins, such as polyarylate; polyester, polycarbonate polystyrene, acrylonitrile-styrene copolymer, acrylonitrile butadiene copolymer, polyvinylbutyral, polyvinylformal, polysulfonyl, polyacrylamide, polyamide, and chloride rubber; and organic photoconductive polymers such as poly-N-vinyl carbazole, polyvinyl anthracene, and polyvinyl pyrene.

Since the charge transporting layer is limited to the charge carriers to be transported, the thickness thereof cannot be enlarged exceeding the necessity. In general, it is 5 to 40 μm, preferably 10 μm to 25 μm. When the charge transporting layer is formed by coating method, the above-described proper coating method can be used.

The photosensitive layer formed by layering the above-described charge generation layer and the charge transporting layer is formed on the conductive substrate. As the conductive substrate, substrate materials having conductivity can be used, being exemplified by: aluminum, aluminum alloy; copper; zinc; stainless steel; vanadium; molybdenum; chrome, titanium; nickel; indium; gold; and platinum. In addition, plastics (for example, polyethylene, polypropylene, polyvinyl chloride, polyethylene terephthalate, acryl resin, and polyethylene fluoride) having a layer to which a film is applied by vacuum evaporating aluminum alloy, indium oxide, tine oxide, indium oxide-tin oxide alloy can be used.

Furthermore, the following can be used: substrates formed by applying conductive particles (for example carbon black and silver particles) together with a proper binder to the above-described metal substrate or plastic; substrates formed by impregnating conductive particles into plastic or paper; and plastic containing conductive polymers.

An undercoating layer may be provided between the conductive substrate and the photosensitive layer. The undercoating layer displays a barrier function and an adhesion function.

The undercoating layer can be formed by polyvinyl alcohol, nitrocellurose, ethylene-acryl acid copolymer, polyamide (Nylon 6, Nylon 66, Nylon 610, nylon copolymer, and alkoxymethyl nylon), polyurethane, gelatine, aluminum oxide.

The preferred thickness of the undercoating layer is 0.1 μm to 5 μm, preferably 0.5 μm to 3 μm.

Furthermore, as the electrophotographic photosensitive material, anelectrophotographic photosensitive material formed in which the above-described azo pigment is contained together with the charge transporting material in one layer can be exemplified.

In this case, a charge-transfer complex compound comprising poly-N-vinyl carbazole and trinitrofluorenone can be used as an alternative to the above-described charge transporting material.

The electrophotographic photosensitive material according to this example can be prepared by performing film-coating after dispersing the above-described azo pigment and the charge-transfer complex compound in a solution of polyester which as been dissolved in tetrahydrofuran.

Any of the electrophotographic photosensitive materials contain at least one type of pigment selected from azo pigments having the organic residual group expressed by general formula (1). In addition, two or more types of the azo pigments containing the organic residual group expressed by the above-described general formula (1) may be combined for use in order to improve the sensitivity of the photosensitive material by using pigments having different light absorbance. Alternatively, they may be combined with the charge generating material selected from known dyes and pigments.

The electrophotographic photosensitive material according to the present invention can be used not only in an electrophotographic copier, but also can be widely used in the electrophotographic field, such as in laser beam printers and CRT printers.

DESCRIPTION OF THE PREFERRED EMBODIMENTS

EXAMPLES 1 to 11

An ammonium-water solution of casein (11.2 g casein, 1 g-28% ammonium water, and 222 ml water) is applied, by using a meyer bar to an aluminum plate such that the dry film thickness is 1.0 μm.

Next, 5 g of the above-described pigment (2-1) was added to a liquid in which 2 g butyral resin (butyral rate 63 mol %) had been dissolved in 95 ml tetrahydrofuran. Then, the compounds were dispersed by using a sand mill for two hours. This dispersed solution is applied, by using a meyer bar to the previously formed casein layer such that the dry film thickness is 0.3 μm. The film is dried so that the charge generating layer is formed.

Next, 5 g p-diethyl aminobenzaldehyde-N-α-naphtyl-N-phenylhydrazone and 5 g polymethyl methacrylate (number average molecular weight 100,000) were dissolved in 70 ml benzene. This liquid was applied, by using a meyer bar, to the charge generating layer such that the dried film thickness was 19 μm. Then, the film was dried to form the charge transporting layer so that the electrophotographic photosensitive material according to Example 1 was prepared.

As an alternative to the exemplified pigment (2-1), the following exemplified pigment was used so that the electrophotographic photosensitive material corresponding to Examples 2 to 11 was prepared in which the other conditions were arranged to be the same as those for Example 1. The thus-prepared electrophotographic photosensitive material was corona charged in a static method at 5.5 KV by using a static copying machine testing device (Model SP-428 manufactured by Kawaguchi Electric Co., Ltd). After the material had been left in a dark place for one second, it was exposed at a luminance of 5 lux so that the charge characteristics were examined.

As the factors to measure charge characteristics, the surface potential and the amount of exposure (E1/2) needed for halving the potential after reducing it in a dark place for once second were examined. The results are as shown below.

| Example Nos. | Exemplified pigment | VO (−V) | $E_{\frac{1}{2}}$ (lux · sec) |
|---|---|---|---|
| 1 | (2-1) | 700 | 3.5 |
| 2 | (2-3) | 705 | 2.8 |
| 3 | (2-5) | 710 | 2.3 |
| 4 | (2-7) | 700 | 2.2 |

-continued

| Example Nos. | Exemplified pigment | VO (−V) | $E_{\frac{1}{2}}$ (lux · sec) |
|---|---|---|---|
| 5 | (2-8) | 698 | 2.2 |
| 6 | (2-11) | 705 | 2.5 |
| 7 | (2-12) | 695 | 2.3 |
| 8 | (2-22) | 705 | 3.2 |
| 9 | (3-1) | 690 | 1.8 |
| 10 | (3-3) | 695 | 1.9 |
| 11 | (3-4) | 700 | 2.1 |

COMPARATIVE EXAMPLES 1 TO 3

A photosensitive material was prepared by the method similar to that of Example 1 except for replacing the azo pigment used in Example 1 by an azo pigment expressed by the following constitutional formula, and similar evaluation was performed. The results are as shown below.

(Comparative Example 1)

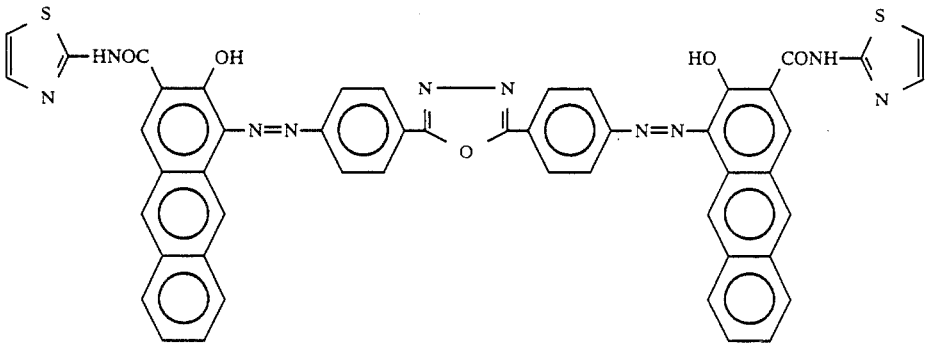

Vo: −685 V
E1/2: 3.8 lux · sec (Comparative Example 2)

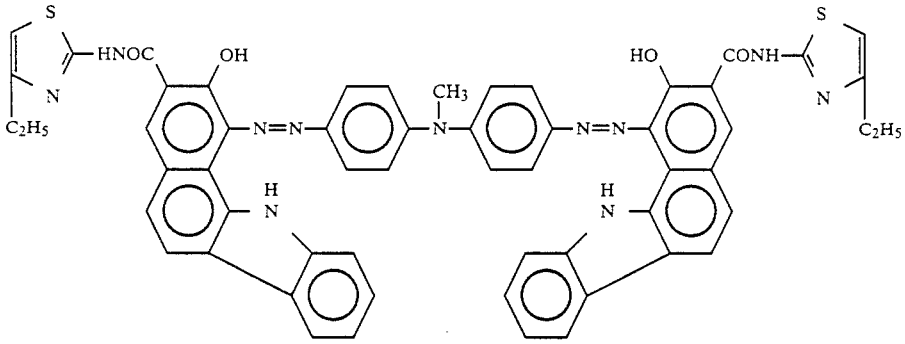

Vo: −695 V
E1/2: 4.2 lux · sec (Comparative Example 3)

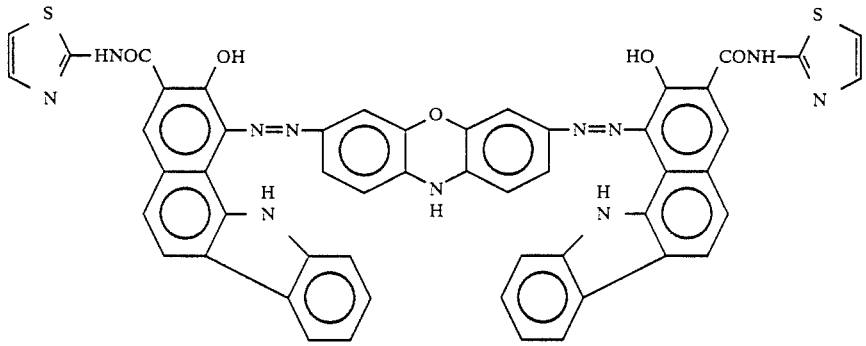

-continued

Vo: −700 V
E1/2: 4.5 lux · sec

Comparative Examples 1, 2, and 3 respectively correspond to Examples 3, 4 and 7. The electrophotographic photosensitive materials respectively display excellent sensitivity.

EXAMPLES 12 TO 15

By using the electrophotographic photosensitive materials prepared in Examples 3, 4, 7, and 10, the potential change at the light portion and at the dark portion at the time of repeated use were measured.

The method for measuring them was as follows: the photosensitive material was applied to the cylinder of an electrophotographic copier including a −5. 6 KV-corona charger, exposing optical system, developer, transfer charger, electricity removing exposing optical system and a cleaner.

By using this copier, the initial light potential ($V_L$): and dark potential ($V_D$) were set to −200 V and −700 V, respectively, and then the light potential ($V_L$) and dark potential ($V_D$) were measured after it had been used 5,000 times repeatedly.

| Example Nos. | Azo Pigments | Initial $V_D$ (−V) | Initial $V_L$ (−V) |
|---|---|---|---|
| 12 | (2-5) | 710 | 10 |
| 13 | (2-7) | 700 | 10 |
| 14 | (2-12) | 695 | 10 |
| 15 | (3-3) | 695 | 5 |
| **Example Nos.** | **Azo Pigments** | **After using 5,000 sheets $V_D$ (−V)** | **After using 5,000 sheets $V_L$ (−V)** |
| 12 | (2-5) | 680 | 20 |
| 13 | (2-7) | 675 | 20 |
| 14 | (2-12) | 670 | 25 |
| 15 | (3-3) | 670 | 25 |

COMPARATIVE EXAMPLES 4 TO 6

The electrophotographic photosensitive material prepared according to Comparative Examples 1 to 3 were, in the method similar to that for Example 12, examined for their change in potential after repeated use. The results are as shown below.

| Comparative Example Nos. | Azo Pigments (Comparative Examples) | 5,000 sheets $V_D$ (−V) | 5,000 sheets $V^L$ (−V) |
|---|---|---|---|
| 4 | 1 | 685 | 10 |
| 5 | 2 | 695 | 10 |
| 6 | 3 | 700 | 10 |
| **Comparative Example Nos.** | **Azo Pigments (Comparative Examples)** | **After using 5,000 sheets $V_D$ (−V)** | **After using 5,000 sheets $V^L$ (−V)** |
| 4 | 1 | 680 | 50 |
| 5 | 2 | 685 | 45 |
| 6 | 3 | 690 | 60 |

As can be clearly seen from the above-described results, the electrophotographic photosensitive material according to the present invention displays excellent characteristics that the potential change can be limited even after repeated use.

EXAMPLE 16

Liquid prepared by dissolving 5 g-2,4,7-trinitro-9-fluorenone and 5 g poly-4,4'-dioxydiphenyl-2,2-propane carbonate (molecular weight 300,000) in 70 ml tetrahydrofuran was applied to the charge generating layer prepared in accordance with Example 1 to provide dry weight per area of 10 g/m$^2$. The thus-prepared electrophotographic photosensitive material was measured in its charge characteristics in the same method as that for Example 1.

The charge polarity at this time was set to positive. The results are as shown below.

V0: +600 V
E1/2: 3.9 lux.sec

EXAMPLE 17

Polyvinyl alcohol film having the thickness of 0.5 μm was formed on the aluminum surface of the aluminum evaporated polyethylene telephthalate film.

Next, the dispersion liquid of the disazo pigment used in Example 1 was applied, by using a meyer bar, to the previously formed polyvinyl alcohol layer in such a manner that the dry film thickness was 0.5 μm. Then, the film was dried so that the charge generating layer was formed.

Then, a liquid obtained by dissolving 5 g of a pyrazoline compound expressed by:

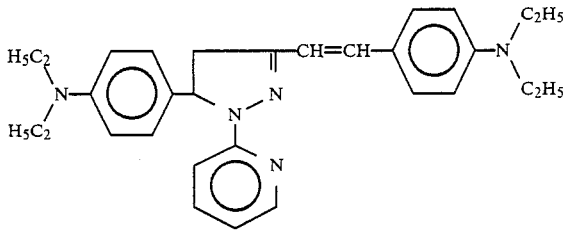

and 5 g polyarylate (condensed polymer of terephthalic acid-isophthalic acid) in 70 ml tetrahydrofuran was applied to the charge generating layer to provide a dry film thickness of 18 μm. Then, the film was dried, so that the charge transporting layer was formed.

The charge characteristics and the durability of the thus-formed electrophotographic photosensitive material were, similarly to Examples 1 and 2, measured. The results are as shown below.

V0: −750 V
E1/2: 3.1 lux.sec
Durability: $V_D$: −705 V, $V_L$: −5 V
After 5000 sheets: $V_D$: −700 V, $V_L$: −10 V

EXAMPLE 18

An ammonium water solution (as described above) of casein was applied to an aluminum plate of thickness 100 μm, and was then dried to from an undercoating layer having a thickness of 0.5 μm.

Next, a charge-transfer complex compound was prepared by dissolving 5 g 2,4,7-trinitro-9-fluorenenone and 5 g (the number average molecular weight 300,00) poly-N-vinyl carbazole in 70 ml tetrahydrofuran.

Liquid obtained by dissolving 1 g of the exemplified pigment (2-8) and 5 g polyester (trade name "Byron" manufactured by Toyo Spinning Co., Ltd) in 70 ml tetrahydrofuran was added to this charge-transfer complex compound, and was dispersed. The thus-dispersed liquid was applied to the undercoating in such a manner that the dry film thickness was 16 μm. Then, the film was dried.

The charge characteristics of the thus-prepared electrophotographics photosensitive material was measured similarly to the method according to Example 1. The results are as shown below, wherein the charge characteristics are arranged to be positive.

V0: +680 V

E1/2 "4.0 lux . sec

EXAMPLE 19

An electrophotographic photosensitive material was prepared similarly to Example 1 except for providing a case in undercoating layer (as described above) can an aluminum plate, and the charge transporting layer and the charge generating layer used in Embodiment 1 were, in the sequential order shown here, layered thereon. The charge characteristics were similarly measured. The charge polarity was arranged to be positive. The results are as shown below.

V0: +680 V

E1/2: 3.9 lux . sec

What is claimed is:

1. An electrophotographic photosensitive material comprising a photosensitive layer containing an azo pigment on an electroconductive substrate thereof, wherein said azo pigment comprises an organic residual group as expressed by the following general formula (I) bonded to an aromatic hydrocarbon group or an aromatic heterocyclic group optionally via a coupling group (I)

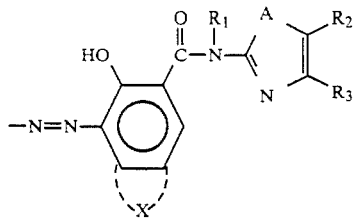

wherein X is a residual group for forming an aromatic hydrocarbon group or an aromatic heterocyclic group condensed with a benzene ring, A is —$NR_4$— wherein $R_4$ is selected from the group consisting of hydrogen atom, alkyl group, aralkyl group or aryl group, $R_1$ is selected from the group consisting of hydrogen atom, alkyl group, aralkyl group or aryl group, and $R_2$ and $R_3$ each is selected from the group consisting of hydrogen atom, alkyl group, aralkyl group, carbamoyl group, aryl group, heterocyclic group, halogen atom, nitro group, acyl group, cyano group or together $R_2$ and $R_3$ form a ring and $R_2$ and $R_3$ are the same or different from each other.

2. An electrophotographic photosensitive material according to claim 1, wherein said azo pigment has the structure expressed by the following general formula (II)

(II)

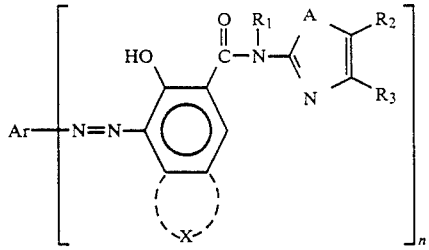

wherein, Ar is an aromatic hydrocarbon group or an aromatic heterocyclic group bonded directly or through bonding group to an azo group and is an integer from 1 to 4.

3. An electrophotographic photosensitive material according to claim 1 or 2, wherein $R_1$ is selected from the group consisting of a hydrogen atom and a lower alkyl group, $R_2$ and $R_3$ are electron attractive absorbing groups, and $R_4$ is selected from the group consisting of a hydrogen atom and a lower alkyl group.

4. An electrophotographic photosensitive material according to claim 1 or 2, wherein $R_1$ is selected from the group consisting of a hydrogen atom and a lower alkyl group, $R_2$ and $R_3$ are electron attracting groups, and $R_4$ is a hydrogen atom.

5. An electrophotographic photosensitive material according to claim 1, wherein said photosensitive layer comprises a layered structured comprising a charge generating layer containing said azo pigment as a charge generating material and a charge transporting layer containing a charge transporting material.

6. An electrophotographic photosensitive material according to claim 5, wherein said charge generating layer comprises an said azo pigment dispersed in a binder.

* * * * *

UNITED STATES PATENT AND TRADEMARK OFFICE

CERTIFICATE OF CORRECTION

PATENT NO. : 4,975,349

DATED : December 4, 1990

INVENTOR(S) : YOSHIO KASHIZAKI

It is certified that error appears in the above identified patent and that said Letters Patent is hereby corrected as shown below:

AT [57] ABSTRACT

Line 1, "electrophotograph" should read --electrophotographic--.
Line 4, "in which an organic comprises" should read --comprises an organic--.

COLUMN 1

Line 47, "in" should read --in---.

COLUMN 2

Line 5, "serving" should read --serves--.
Line 52, "used." should read --use.--.
Line 62, "layer containing" (first occurrence) should be deleted.
Line 64, "comprises in which" should read --comprises--.

COLUMN 3

Line 14, "condense" should read --condensed--.

COLUMN 4

Line 19, "tetraphenyl benzidine" (second occurrence) should be deleted.

COLUMN 7

Line 5, "phenoaxadine;" should read --phenoxadine;--.

UNITED STATES PATENT AND TRADEMARK OFFICE

CERTIFICATE OF CORRECTION

PATENT NO. : 4,975,349

DATED : December 4, 1990

INVENTOR(S) : YOSHIO KASHIZAKI

It is certified that error appears in the above-identified patent and that said Letters Patent is hereby corrected as shown below:

COLUMN 8

Line 4, "R" should read --$R_1$--.

COLUMN 29

Exemplified Pigment (2-30), " 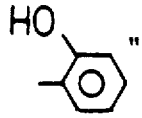 " should read

-- Cpl : 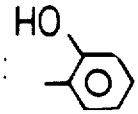 --.

COLUMN 37

Line 49, "alkali Al" should read --alkali. Al--.

COLUMN 38

Line 49, "express" should read --expressed--.
Line 63, "stirring Next," should read --stirring. Next,--.

COLUMN 39

Line 16, "utes Next," should read --utes. Next,--.
Line 53, "due the" should read --due to the--.

UNITED STATES PATENT AND TRADEMARK OFFICE

CERTIFICATE OF CORRECTION

PATENT NO. : 4,975,349

DATED : December 4, 1990

INVENTOR(S) : YOSHIO KASHIZAKI

It is certified that error appears in the above-identified patent and that said Letters Patent is hereby corrected as shown below:

COLUMN 40

Line 2, "pyrolidone." should read --pyrrolidone.--.
Line 29, "dichaloroethylene," should read --dichloroethylene--.
Line 34, "cally" should read --cal--.
Line 57, "hydrodine-3-" should read --hydrodino-3-"
Line 61, "aminobenzaldehide-N," should read --aminobenzaldehyde-N,--.
Line 62, "benzaldehide-N" should read --benzaldehyde-N--.
Line 63, "p-pyrodinobenzaldehide-N," should read --p-pyrodinobenzaldehyde-N,--.
Line 64, "2-aldehide-N," should read --2-aldehyde-N,--.
Line 65, "p-diethylbenzaldehide-3" should read --p-diethylbenzaldehyde-3--.

COLUMN 41

Line 2, "pyrozo-" should read --pyrazo---.
Line 3, "spiropyrozoline" should read --spiropyrazoline--.
Line 24, "selected" should read --selecting--.
Line 53, "tine oxide," should read --tin oxide,--.
Line 54, close up right margin.
Line 55, close up left margin.
Line 67, "nitrocellurose," should read nitrocellulose,--.

COLUMN 42

Line 6, "anelectrophotographic" should read --an electrophotographic--.
Line 18, "as" should read --has--.

UNITED STATES PATENT AND TRADEMARK OFFICE

CERTIFICATE OF CORRECTION

PATENT NO. : 4,975,349

DATED : December 4, 1990

INVENTOR(S) : YOSHIO KASHIZAKI

It is certified that error appears in the above-identified patent and that said Letters Patent is hereby corrected as shown below:

COLUMN 45

Line 23, "$(V_L)$:" should read --$(V_L)$--.
Line 52, "5,000 sheets" should read --Initial--.
Line 59, "$V^L(-V)$" should read --$V_L(-V)$--.

COLUMN 46

Line 25, "telephthalate" should read --terephthalate--.
Line 66, "fluorenenone" should read --fluorenone--.
Line 67, "300,00)" should read --300,000)--.

COLUMN 47

Line 10, "trophotographics" should read --trophotographic--.
Line 15, "E1/2 "4.0 lux . sec" should read --E1/2:4.0 lux . sec--.
Line 20, "case in" should read --casein-- and "can" should read --on--.

UNITED STATES PATENT AND TRADEMARK OFFICE

CERTIFICATE OF CORRECTION

PATENT NO. : 4,975,349

DATED : December 4, 1990

INVENTOR(S) : YOSHIO KASHIZAKI

It is certified that error appears in the above-identified patent and that said Letters Patent is hereby corrected as shown below:

COLUMN 48

Line 29, "and is" should read --and n is--.
Line 45, "structured" should read --structure--.
Line 51, "an said" should read --said--.

Signed and Sealed this

First Day of December, 1992

*Attest:*

DOUGLAS B. COMER

*Attesting Officer*

*Acting Commissioner of Patents and Trademarks*